US006039486A

United States Patent [19]

Breslin

[11] Patent Number: 6,039,486

[45] Date of Patent: Mar. 21, 2000

[54] PEN

[76] Inventor: Daniel V. Breslin, 7934 Ridge Ave., Philadelphia, Pa. 19128

[21] Appl. No.: 08/856,969

[22] Filed: May 15, 1997

[51] Int. Cl.[7] ..... A45D 40/20

[52] U.S. Cl. ..... 401/88; 401/52; 401/198

[58] Field of Search ..... 401/88, 98, 198, 401/199, 195, 52, 202

[56] References Cited

U.S. PATENT DOCUMENTS

| | | | |
|---|---|---|---|
| 220,632 | 10/1879 | Mcgill | 401/52 |
| 256,738 | 4/1882 | Reckendorfer et al. | 401/52 |
| 501,225 | 7/1893 | Flake | 401/52 |
| 1,725,064 | 8/1929 | Easton | 401/195 |
| 1,738,496 | 12/1929 | Laux | 401/195 |
| 3,424,539 | 1/1969 | Jenkins | 401/199 |
| 3,510,934 | 5/1970 | Koelichen | 401/198 |
| 4,723,859 | 2/1988 | Kitoh | 401/199 |
| 4,824,271 | 4/1989 | Nagahama et al. | 401/199 |

FOREIGN PATENT DOCUMENTS

| | | | |
|---|---|---|---|
| 1420452 | 10/1964 | France | 401/202 |

*Primary Examiner*—David J. Walczak
*Attorney, Agent, or Firm*—Paul & Paul

[57] ABSTRACT

A marking pen having a deformable tip, and adapted to apply ink or the like to a surface in a stroke of uniform width. The deformable tip has a pocket or recess in its marking surface, that allows a leading edge of the tip that is applied to a surface to be marked, to remain substantially a straight line during the marking stroke, rather than curling at its edges and producing a stroke of lesser width. A scraping blade is also provided carried by the pen, preferably by a cap for the pen. The invention is particularly useful in marking numbered zones of lottery cards, and in scraping away opaque layers for instant lottery cards or tickets.

15 Claims, 4 Drawing Sheets

PEN

BACKGROUND OF THE INVENTION

When a pen of conventional type is used for making a mark on electronically scanned cards, such as, for example, on lottery cards, where a plurality of numbers are to be marked over, each of a necessary predetermined width and length, the conventional pens or pencils generally used for such purpose are often unsatisfactory. The reason they are unsatisfactory, is that the marks that are made by a pen or pencil are usually thinner than the width of the space that is to be marked out, requiring a plurality of back-and-forth strokes to completely fill in the space provided for each mark that is to be made on a lottery card. Similarly, in many other instances, such as in completing ordering forms, where marks must be made on cards or spaces on other documents, or when marks are to be made on various testing documents, such as aptitude testing documents or the like, the same problems exist; that is, conventional marking instruments do not clearly mark in the space with the desired width of mark, in a single stroke.

Some efforts have been made to provide instruments for addressing the problem of marking in spaces on cards or other documents, without requiring a great plurality of back-and-forth stroke motions. One such approach has been in the use of felt tipped pen, whereby liquid ink is applied through a felt tip, which tip is designed to have a desired width, corresponding to the desired width of a single stroke. However, when pressure is applied to the pen and the felt tip is urged under a given force across a surface to be marked, the leading edge of the felt tip that forms a line of greatest pressure will deform under the applied force, so that opposite edges of the leading edge curve backwardly away from the direction of motion of the pen, thereby reducing the width of the stroke. Then, in order to compensate, the user of the pen applies further pressure on the leading edge in an effort to widen the width of the stroke, to its intended width. This pressure only causes a further backward bending or arcuate motion, such that the radius that is formed at the ends of the leading edge increases, thereby compounding the problem.

SUMMARY OF THE INVENTION

The present invention is directed toward providing a pen that will allow a uniform width of pen stroke, such that pressure that is applied to the leading edge of a deformable tip of the pen will allow the leading edge to remain straight, without becoming arcuate at its ends, such that a linear line having a width corresponding to the width of the tip is maintained throughout the marking, to yield a stroke of uniform width.

The present invention is particularly desirable for use on state lottery cards and the like, which will encompass order cards wherein blocks similar to those on lottery cards must completed, the marking of testing documents, such as for example aptitude tests and the like, and other similar uses where uniform width of pen stroke is desirable.

Additionally, the pen provided with a blade that is particularly desirable for scratching away a removable opaque surface to reveal indicia disposed on a substrate beneath the surface. This latter feature is particularly useful, when scraping away hidden layer of an "instant" winner lottery card, wherein the surface that is to be scraped away hides the pre-applied lottery number, such that the scraping away of the surface reveals the number.

OBJECTS OF INVENTION

Accordingly, it is an object of the present invention to provide a novel pen for use on electronically scanned cards and like uses where uniform width of a pen stroke is desirable by providing a recess or pocket in the tip of the pen.

It is a further object of this invention to accomplish the above object, wherein said pocket or recess allows for a reduction in resistance to deformation of certain portions of the tip, as force is applied to the tip in making a pen stroke against a surface.

It is a further object of this invention to accomplish the above objects, whereby as force is applied to a leading edge of a pen tip, and as that leading edge is slid or dragged across a surface, the mass of the pen tip that would ordinarily resist deformation is reduced from what it would be if there were not a pocket or recess in the pen tip.

It is an additional object of this invention to accomplish the above objects, whereby the pocket or recess closes somewhat as force is applied to the pen tip in use, such that the leading edge of the pen tip remains essentially straight and linear.

It is another object of this invention to accomplish the above objects, wherein a blade is also provided, carried by the pen, for scraping away portions of a multi-layer member to reveal information beneath the original surface of the member, and to provide such a blade carried by a pen independently of the above-mentioned improvements in the pen tip.

Other objects and advantages of the present invention will be readily understood upon a reading of the following brief descriptions of the drawing figures, detailed descriptions of the preferred embodiments, and the appended claims.

BRIEF DESCRIPTION OF THE DRAWING FIGURES

FIG. 1 is an illustration of a pen in accordance with this invention, with the portion of the pen that includes the reservoir being fragmentally illustrated for purposes of clarity, and with the pen being disposed with its tip ready for use to make a stroke of the width of a numbered zone on a lottery card or the like.

Figure 4:
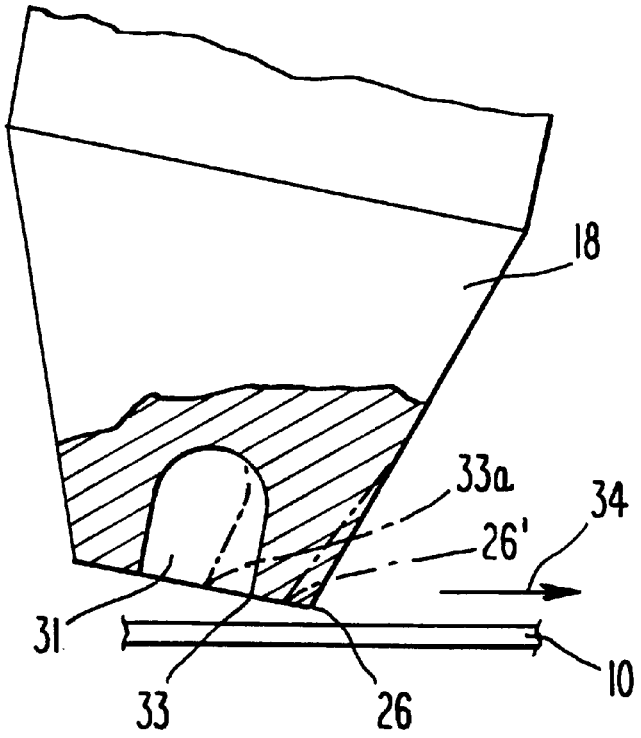

FIG. 4 is an enlarged partially vertical sectional side illustration of a pen tip adapted to be dragged across a lottery card or like member to be marked, with the leading edge thereof being illustrated in full line and phantom positions, with the phantom position illustrating the leading edge position under the applied marking force, wherein a pocket or recess is shown in the end of the tip, in both full line (undeformed) and phantom (deformed) illustrations.

Figure 5:
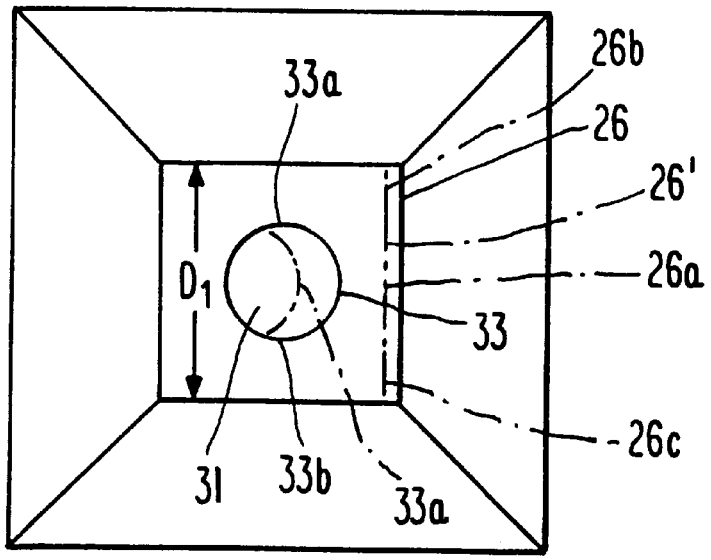

FIG. 5 is a bottom illustration of the marking pen of FIG. 4, with the leading edge being shown in both full line and phantom positions, wherein a pocket or recess is shown in the end of the tip, in both full line (undeformed) and phantom (deformed) illustrations.

Figure 6:
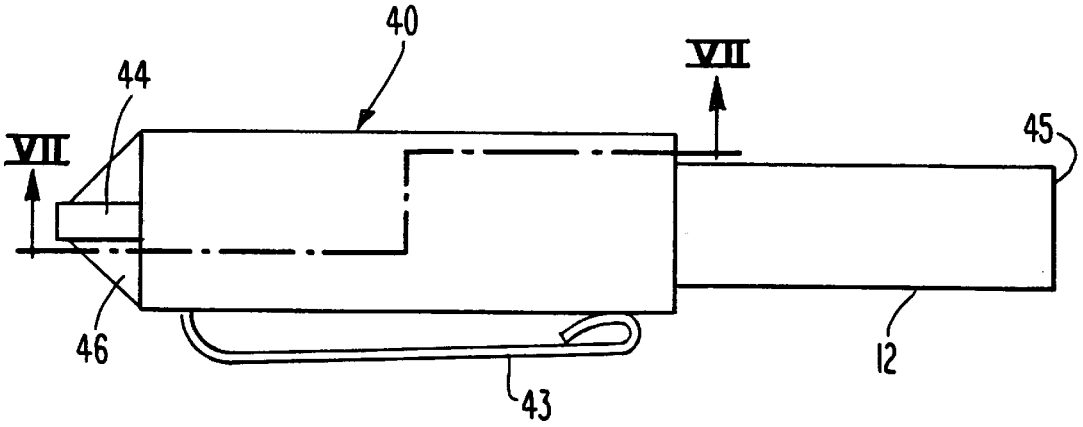

FIG. 6 is an illustration of the pen with a removable cap disposed thereon, with the cap having a scraping blade at the left end thereof and a pocket clip carried thereby.

Figure 7:
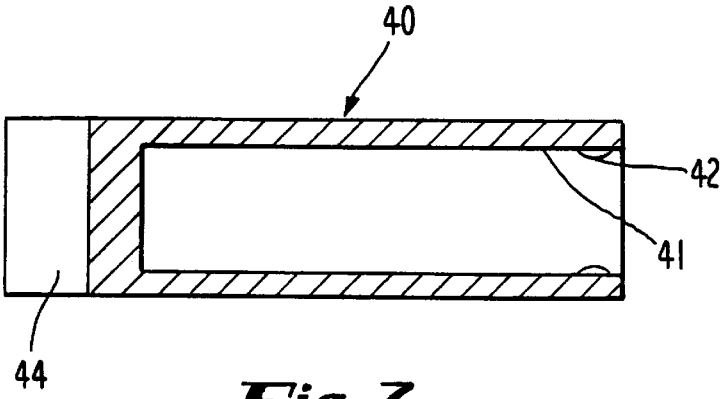

FIG. 7 is a longitudinal sectional view, taken through the cap of the pen of FIG. 6, generally along the line VII—VII of FIG. 6.

DETAILED DESCRIPTIONS OF THE PREFERRED EMBODIMENTS

Figure 1:
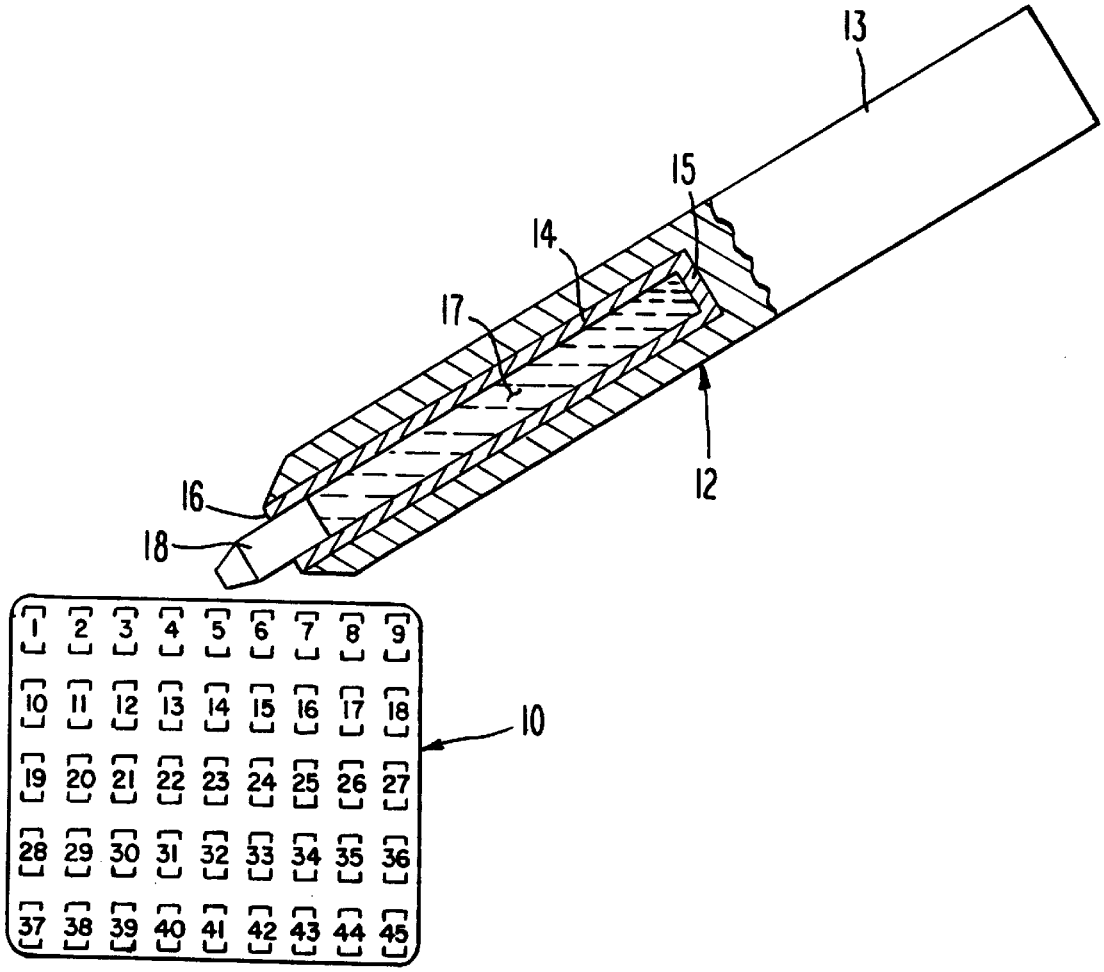

Referring now to the drawings in detail, reference is first made to FIG. 1, wherein a section of a lottery card or the like 10 is illustrated, which, it will be understood, could also be an order form, a section of a test card, or the like. In the particular portion 10 of the lottery card, it will be seen that various marking zones numbered from 1–45 are illustrated, each of elongated rectangles, from top to bottom. It will be seen that the width of each of the rectangles corresponds generally to the width of the tip of the pen disposed immediately above zone 5, for example, as zone 5 is about to be marked in with a stroke that is the width of zone 5.

The pen of this invention is generally designated by the number 12, and includes a pen body 13 in the form of an elongate structure, having a cylindrical insert 14 disposed therein, terminating in a closed upper end 15, and an open lower end 16, forming a reservoir 17 therein which carries ink in the form of a liquid.

Figure 2:
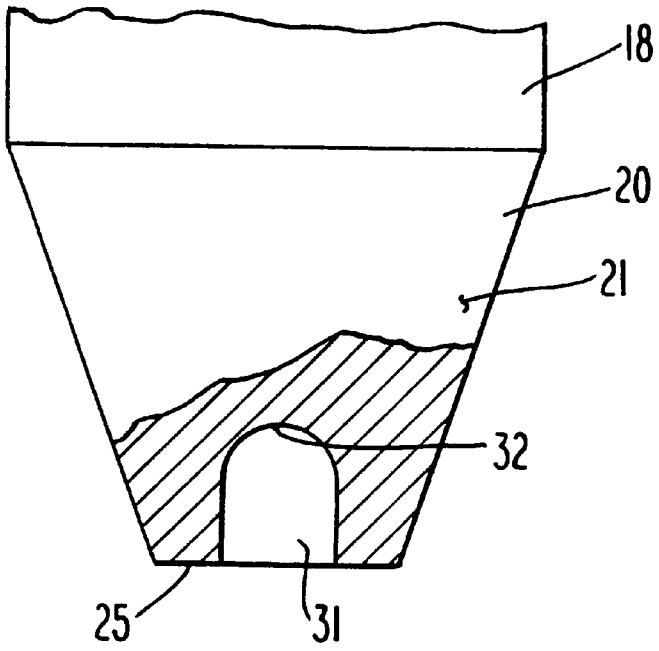
FIG. 2 is an enlarged, fragmentary, partially sectionally vertical illustration of a pen tip, taken generally along the line II—II of FIG. 3.
Figure 3:
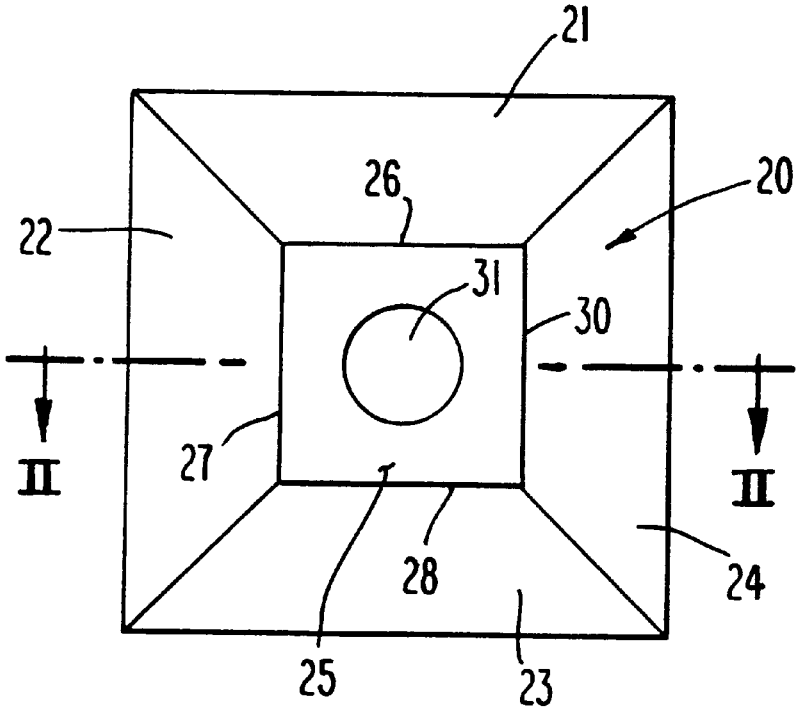
FIG. 3 is a bottom view of the pen tip of FIG. 2.

A deformable tip 18 is provided, preferably constructed of felt, sponge, or other deformable materials, capable of being wet with ink from the reservoir 17. The tip 18, as shown in FIGS. 2 and 3, has a terminal marking end 20 that is configured as truncated pyramid of four equal sides 21, 22, 23 and 24, terminating in a generally transverse outer surface 25 that faces away from the reservoir 17, which outer surface 25 is defined by four generally straight unbroken lines 26, 27, 28, and 30, as shown in FIG. 3 any one of which can function as a leading edge to which force is applied when the pen is used to mark a surface.

The tip 20 is provided with a pocket or recess 31 in the surface 25, generally centrally disposed, symmetrical therein. The pocket 31 may take on various geometric shapes, but will preferably be cylindrical as shown, terminating internally in a domed or concave surface 32.

With reference now to FIGS. 4 and 5, it will be seen that, with the pen of this invention, as the leading edge 26 is moved along the upper surface of the card 10 in the direction of the arrow 34, the leading edge 26, under the applied marking force, will move from the full line position therefore illustrated in FIG. 4, to the phantom line position 26', and the cylindrical pocket 31 will have its forward-most portion or wall move from the full line position 33 therefore, to the phantom line position 33*a*, at least partially closing the pocket 31 as shown in FIGS. 4 and 5. It will also be noted that the leading edge 26, 26', even under the applied force, remains a straight line as shown in FIG. 5, having a dimension $D_1$.

As is illustrated in FIGS. 4 and 5, it can be seen that the pocket 31 effects a reduction in the resistance to deformation for the deformable tip 18 for a portion of the tip behind the leading edge. That is, normally the mass of the tip, being constructed of felt, sponge or the like, resists deformation under the force that is applied as the leading edge of a pen is slid or dragged along a surface to be marked.

This mass of the pen tip is greatest inside the center of the leading edge 26*a* and remains substantially the same for some distance each side of absolute center. However, at the very ends, such as at points 26*b* and 26*c* along the line, nearest the edges, the mass that resists deformation approaches zero as one approaches the ends of the line 26. In order to compensate for the resistance of mass to deformation, the pocket 31 provides a means for reducing the mass the greatest amount at the very center of line 26*a*, in that the dimension from the periphery of the pocket 31, nearest the leading edge; namely at point 33, is the shortest dimension to the leading edge 26, and such dimension increases as one moves away from the center of the leading edge 26. The distance from the periphery of the pocket 31 to the leading edge 26 thus gradually increases from point 33 on said periphery, as one goes around the circumference of the pocket 31, until such a distance is maximized at locations 33*a* and 33*b* on the leading periphery of the pocket 31.

It will be understood that the pocket 31 may take on various other configurations other than cylindrical, such as rectangular, triangular, pentagonal, etc. as viewed in the illustration of FIG. 5, for example. However, preferably, the pocket 31 will be generally symmetrical and centrally disposed relative to the edges 26, 27, 28, 30, so that any such edge may function as a leading edge. However, if it were desired to limit the number of leading edges, the pocket 31 could be made of any given shape, even reaching completely to edges other than the leading edge.

It will also be understood that while the embodiment of FIGS. 4 and 5 shows that any of the edges 26, 27, 28, and 30 could be a leading edge, it will be understood that in such an embodiment where the edges that could function as leading edges or straight lines, the tip 18 need not have a lower surface 25 as shown, that is rectangular, but that such could be triangular, pentagonal, etc.

Thus, in accordance with this invention it will be seen that when forces are applied to the leading edge of a pen tip with a pocket, the center portion of the wall inboard of the leading edge can collapse inwardly, somewhat, as shown in FIGS. 4 and 5, leaving the ends 26*b* and 26*c* of the leading edge, which would ordinarily have lesser mass resistance to deformation, with increased mass resistance to deformation, such that substantially all portions along the leading edge 26 will have comparable levels of mass resistance to deformation, whereby the leading edge 26 will remain substantially a straight line.

Accordingly, the stroke of ink that is applied a leading edge will be substantially uniform, and the various numbered zones of a lottery ticket or the like 10 may be marked in with a single stroke of the pen though each such zone.

With reference to FIGS. 6 and 7, it will be seen that the pen 12 is provided with a removable cap 40. The cap 40 has its interior as shown in FIG. 7, and will generally include a cylindrical bore or the like 41 therein, preferably having a plurality of protrusions 42 or other means for causing the cap 40 to engage the outer surface of the pen 12 in snap-on, snug relation, to hold the cap 40 onto the pen 12 when the same is applied thereto, but yet to allow the cap 40 to be readily removed from the pen 12.

The cap 40 will preferably have a pocket clip 43 carried thereby.

In accordance with this invention, the pen has a scraping blade 44 carried thereby. In the preferred form of the invention illustrated in FIGS. 6 and 7, the scraping blade 44 is carried by the cap 40. However, the scraping blade 44, if desired, could be carried by the end 45 of the pen 12.

In accordance with the preferred embodiment illustrated in FIGS. 6 and 7, the scraping blade 45 will generally be of metal, such as steel, aluminum, or the like construction, and such is sealingly or adhesively embedded in the left end 46 of the cap 40, so as to be carried thereby. The scraping blade 44 may then be used in conjunction with the use of the pen having the tip 18 of this invention, most particularly adapted for lottery ticket use. To this end, when it is desired to purchase an "instant" ticket, such that immediately after the ticket is purchased one can scrap away a removable, generally opaque portion or layer of the ticket, to reveal indicia carried by another layer of the ticket, to see if one has won a prize, one can simply use the scraping blade 44 to remove the removable opaque layer that covers up the symbol, number or the like therebeneath, and to instantly discover if the purchased ticket provides a win or not. It will be understood that the scraping blade 44 of this invention may be used for lottery tickets in which the indicia beneath the opaque surface layer that is to be scrapped away, whether that indicia is the form of a number, a series of numbers, a picture, or in any other form. It will also be understood that a scraping blade 44 in accordance with this invention may be used for purposes other than for uncovering winning numbers hidden beneath the surface in lottery tickets. For example, in the taking of tests, where particular zones are to be marked to indicate test answers, rather than marking them by application of ink to a zone, one might allow for the scraping away of a layer from a zone, and such will comprise the desired mark. Similarly, in selecting materials to order, in sending in magazine return cards or the like, one might utilize either or both of the scraping blades or pen tip in accordance with this invention for such purposes as well.

It will be understood from the foregoing that various modifications may be made in the details of construction, as well as in the use and operation of the device of this invention, all within the spirit and scope of the invention, as claimed. For example, while the pen may be constructed of various materials, often plastic materials will be preferred. Similarly, while the reservoir of the pen in accordance with this invention may hold ink, other substances, of various colors, and in various physical states may also be used to apply markings. While various materials are suggested herein for construction of the pen tip, it will be understood that, within the spirit and scope of the invention, even other materials may be substituted. Also, while the scraping blade of this invention will preferably be constructed of a metal material, it should be understood that certain plastics having suitable scraping edges may also be utilized, as well as many other materials.

In accordance with this invention, the pen tip will allow the avoidance of errors in making marks on cards and the like, will save computer reading time, as well as manual hours in reading cards that are marked, at the same time reducing the level of error.

What is claimed:

1. A pen for use on electronically scanned cards and like uses where uniform width of the pen stroke is desirable, comprising:

(a) a pen body adapted to be grasped during use;

(b) a reservoir in the pen body for containing ink;

(c) a deformable tip in communication with said reservoir for receiving ink therefrom, with said tip protruding from an end of the body;

(d) said tip having an unbroken outer periphery; and (e) a pocket in said tip.

2. The pen of claim 1, wherein said pocket comprises means reducing resistance to deformation of portions of said tip as force is applied to said tip in making a pen stroke against a surface.

3. The pen of any one of claims 1–2 wherein said tip has a generally transverse outer surface facing away from the reservoir, and with the pocket comprising an opening in said outer surface.

4. The pen of claim 3, wherein said opening is generally circular at said outer surface.

5. The pen of claim 4, wherein said pocket is generally cylindrical.

6. The pen of claim 2, wherein said tip has a generally transverse outer surface facing away from the reservoir, and with the pocket including an opening in said outer surface, wherein said outer surface is defined by a plurality of generally straight lines, each forming a tip stroke edge with each edge having a center.

7. The pen of claim 6, wherein the pocket is arranged relative to said tip stroke edges to comprise means for minimizing, at the center of a tip stroke edge, resistance to deformation during the making of a pen stroke.

8. The pen of claim 7, wherein said opening is located some distance away from each tip stroke edge, wherein the distance from said opening to a stroke edge is least at the center of a stroke edge.

9. The pen of claim 1, wherein said tip has a terminal marking end that is configured as a truncated pyramid.

10. The pen of claim 9, wherein said tip has a generally transverse outer surface facing away from the reservoir, and with the pocket including an opening in said outer surface.

11. The pen of claim 9, wherein said pyramid is essentially equi-sided.

12. The pen of any one of claims 1–2, including a scraping blade carried by the pen.

13. The pen of claim 12, wherein said blade comprises means for scraping an opaque surface layer from a member to be scraped, to reveal indica on the member beneath the opaque surface layer.

14. The pen of claim 12, wherein a removable cap is provided for the pen, for removably covering said tip when the pen is not in use; and wherein said blade is carried by said removable cap.

15. The pen of claim 14, wherein said blade comprises means for scraping an opaque surface layer from a member to be scraped, to reveal indica on the member beneath the opaque surface layer.

* * * * *